US005323575A

United States Patent [19]

Yeh

[11] Patent Number: 5,323,575

[45] Date of Patent: Jun. 28, 1994

[54] TILE AND MOUNTING MAT ASSEMBLY

[76] Inventor: Tzung-Jzng Yeh, No. 232-1, Ta-Hu Rd., Ying-Ko Chen, Taipei Hsien, Taiwan

[21] Appl. No.: 69,849

[22] Filed: Jun. 1, 1993

[51] Int. Cl.[5] ..... E04F 15/00

[52] U.S. Cl. ..... 52/177; 52/386; 52/390

[58] Field of Search ..... 52/177, 384, 386, 390, 52/392, 387, 389, 391; 404/34, 43, 44

[56] References Cited

U.S. PATENT DOCUMENTS

| | | | |
|---|---|---|---|
| 3,676,971 | 7/1972 | Dombroski | 52/386 X |
| 4,287,693 | 9/1981 | Collette | 52/177 |
| 4,361,614 | 11/1982 | Moffitt, Jr. | 52/177 X |
| 4,599,254 | 7/1986 | Cuttica | 52/387 X |
| 4,761,926 | 8/1988 | Rea et al. | 52/387 |

FOREIGN PATENT DOCUMENTS

| | | | |
|---|---|---|---|
| 44371 | 1/1982 | European Pat. Off. | 52/390 |
| 2467938 | 5/1981 | France | 52/389 |

*Primary Examiner*—Carl D. Friedman

*Assistant Examiner*—Kevin D. Wilkens

*Attorney, Agent, or Firm*—Michael D. Bednarek

[57] ABSTRACT

A tile and mounting mat assembly comprises at least one tile and a mounting mat which is able to receive four tiles. The tile has at least one hole on the back thereof. The mounting mat includes four side walls and a plurality of primary ribs. Two neighboring walls of the four side walls have a plurality of pairs of snap feet and the other two neighboring walls of the four side walls have a plurality of connecting hooks. The primary ribs are crossed within the side walls so as to define at least a first intersection point and partition the mounting mat into at least four frames. Each of the frames has a plurality of secondary ribs. The plurality of secondary ribs are crossed so as to define a plurality of second intersection points, wherein a plurality of positioning posts are respectively formed at each of the second intersection points so as to fit into the holes of a tile when the tile and the mounting mat are assembled, whereby at least four tiles are mounted on the mounting mat.

10 Claims, 2 Drawing Sheets

TILE AND MOUNTING MAT ASSEMBLY

BACKGROUND OF THE INVENTION

1. Field of the Invention

The present invention relates to a tile and mounting mat assembly, particularly to a tile and mounting mat assembly which is employed for facilitating replacement of a used tile with a new one.

2. Prior Art

Nowadays, a mixture of cement and water is still needed for affixing tiles to a floor. This conventional method for laying tiles on a floor requires a special technique. Usually a professional carpenter is hired to do the job. Meanwhile, a relatively long time is needed for the cement to dry. Therefore, the conventional method is costly and time-consuming. In addition to the above disadvantages, remodeling the floor for a new layout of color tiles is difficult. In the process of remodeling, all of the tiles are inevitably destroyed. Therefore, remodeling the floor is not only difficult to perform but also wasteful of tiles.

SUMMARY OF THE INVENTION

An object of the present invention is to provide a tile and mounting mat assembly.

Another object of the present invention is to provide a tile and mounting mat assembly which is capable of facilitating replacement of a used tile with a new one.

To accomplish the above objects, a tile and mounting mat assembly according to the present invention comprises: at least one tile, the tile having at least one hole on the underside thereof; and a mounting mat including four side walls and a plurality of primary ribs, a first two walls of the four side walls having a plurality of pairs of snap feet and a second two walls of the four side walls having a plurality of connecting hooks, the primary ribs being crossed within the side walls so as to define at least a first intersection point and partition the mounting mat into at least four frames, each of the frames having a plurality of secondary ribs, the plurality of secondary ribs being crossed so as to define a plurality of second intersection points, wherein a plurality of positioning posts are respectively formed at each of the second intersection points so as to fit into the holes of a tile, whereby at least one tile is mounted on the mounting mat.

Furthermore, each pair of the feet is provided with two protrusions facing each other. The outline of the positioning post is in the shape of a tapered cylinder and a slot is formed on the distal end of the positioning post. The primary ribs are provided with a plurality of supporting posts on the underside thereof. The secondary ribs are provided with a supporting pad at each of the second intersection points. The primary ribs are provided with a draining hole at the first intersection point.

According to the preferred embodiment of the present invention, the number of tiles and number of holes thereof are respectively four. Moreover, the number of the primary ribs is two so as to form one first intersection point and four frames, and the number of secondary ribs is four, so as to form four second intersection points and partition each of the frames into a 3 by 3 matrix of openings, whereby the four tiles are mounted on the mat. In addition, the middle opening of the matrix is filled with a reinforcing plate.

A more detailed understanding of the present invention can be achieved by reading the following detailed description in conjunction with the accompanying drawings.

BRIEF DESCRIPTION OF THE DRAWINGS

Referring to FIG. 1, which is an exploded perspective view of the tile and mounting mat assembly according to the present invention, a tile 1 has four holes 111 on its underside 11. A mat 2 has first to fourth side walls 2A–2D and two primary ribs **22*a* and 22*b*. The walls 2A and 2B are respectively provided with three connecting hooks 67. The walls 2C and 2D are respectively provided with three pairs of snap feet 66. Each pair of snap feet 66 is further provided with a pair of protrusions 66*a* and 66*b* facing each other. The two primary ribs 22*a* and 22*b* are respectively provided with a plurality of supporting posts 33. The two primary ribs 22*a* and 22*b* are crossed so as to divide the mounting mat 2 into four frames 21A and to form a first intersection point 24. Each frame 21A is further divided into nine openings 29 by four secondary ribs 30 and then four second intersection points 34 are formed. A positioning post 26 is provided at each second intersection point 34. Each positioning post 26 is in the shape of a tapered cylinder and a slot 26A is provided on the upper end thereof for facilitating mounting the tile 1 on the mat 2. A supporting pad 27 is provided at the opposite side of each positioning post 26. The middle opening of the matrix of nine openings 29 is filled with a reinforcing plate 28 formed among four second intersection points 34 so as to strengthen the structure of each frame 21A. In addition, a draining hole 43 is provided at the first intersection 24**.

Figure 1:
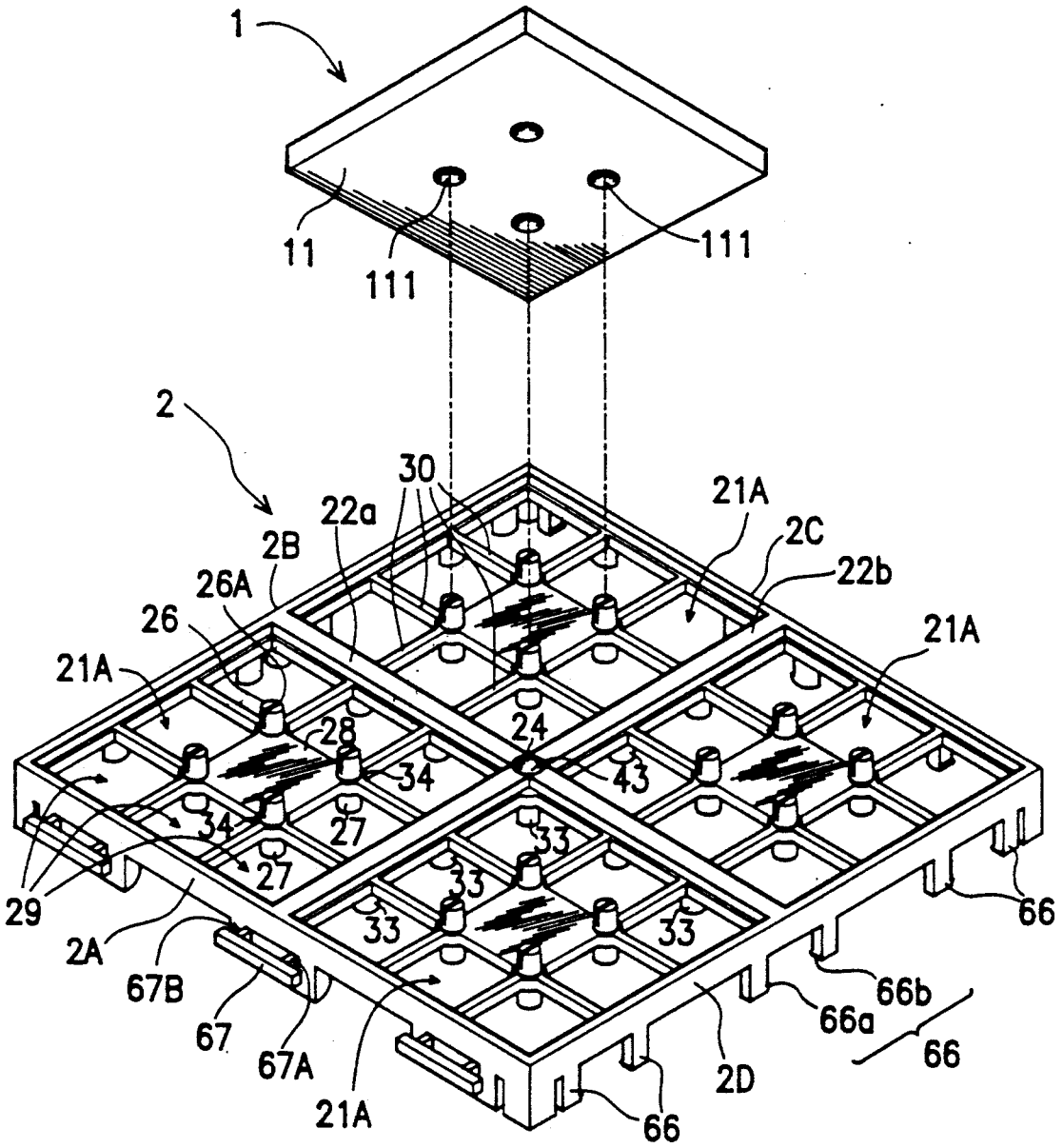
FIG. 1 is an exploded perspective view of the tile and mounting mat assembly according to the present invention.
Figure 2:
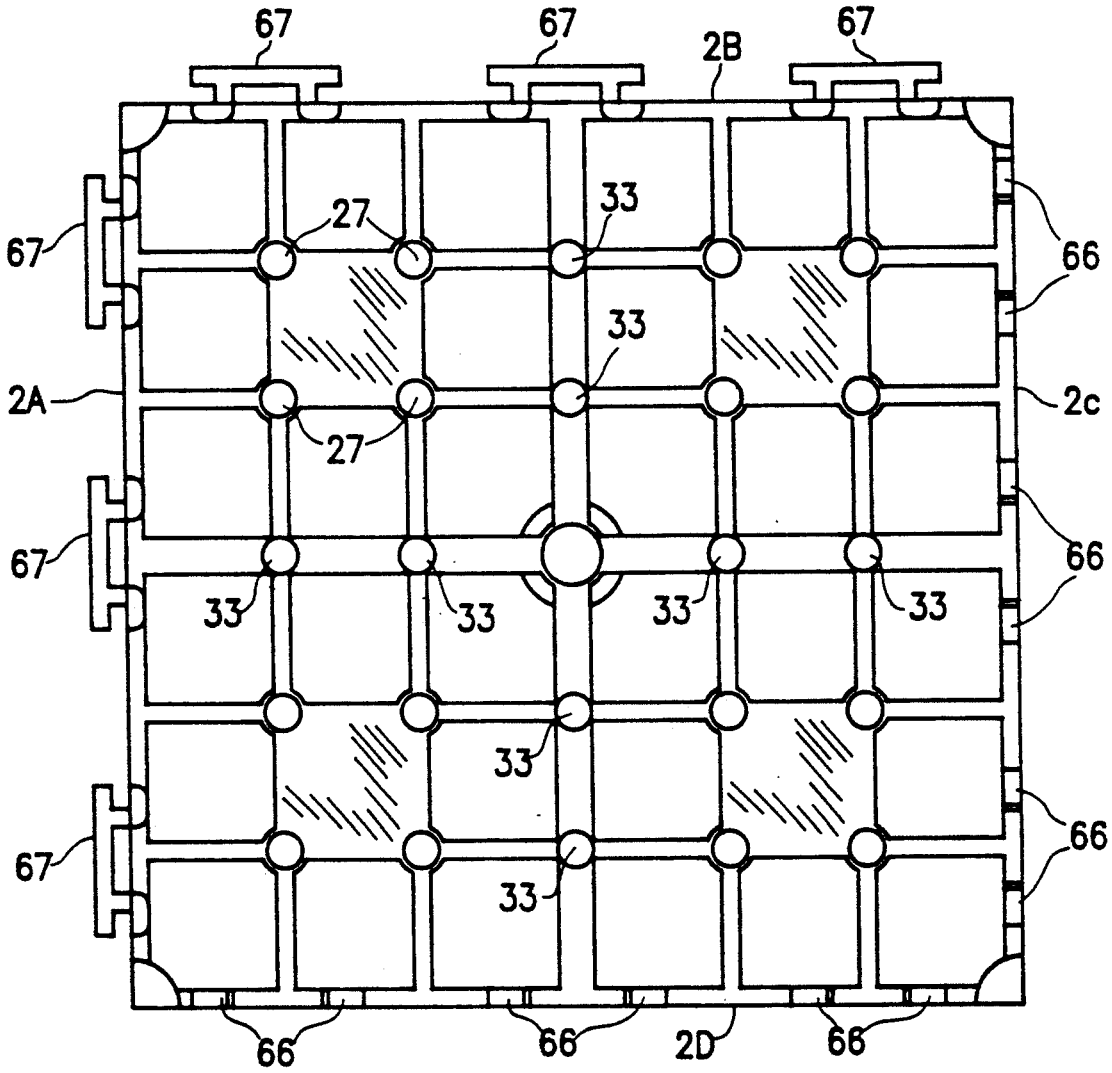
FIG. 2 is the bottom view of the mounting mat according to the present invention.

The mounting mat 2 is made of a flexible material such as rubber. Each mounting mat 2 is able to receive four tiles 1. Moreover, each mounting mat is capable of being connected to other mounting mat by pushing respectively feet 66A and 66B of the snap feet 66 into openings 67B and 67A defined by the hook 67 and the side wall 22A–22D. Thus, a large area of the floor will be covered by the tile and mounting mat assembly. When any tile is broken, the broken one is easily replaced. Furthermore, when a new design of a floor, such as color or pattern, is required, part of all the tiles or all the tiles on the floor are capable of being easily removed. Therefore, remodeling the floor is quickly achieved and the cost of remodeling is lowered. Furthermore, there is no need to hire a skilled craftsman to do the job. In addition, the draining hole 43 is used for allowing the water on the floor to be discharged while the floor is being cleaned. Moreover, a rubber cover (not shown) may be provided for the hole 43 so as to prevent it from being blocked by dirt.

While the invention has been described by way of example and in terms of a preferred embodiment, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A tile and mounting mat assembly, which comprises:

at least one tile, the tile having at least one hole on the back thereof; and a mounting mat including four side walls and a plurality of primary ribs, a first two walls of the four side walls having a plurality of pairs of snap feet and a second two walls of the four side walls having a plurality of connecting hooks, the primary ribs being crossed within the side walls so as to define at least a first intersection point and partition the mounting mat into at least four frames, each of the frames having a plurality of secondary ribs, the plurality of secondary ribs being crossed so as to define a plurality of second intersection points, wherein a plurality of positioning posts are respectively formed at each of the second intersection points so as to fit into the holes of a tile when the tile and the mounting mat are assembled, whereby at least four tiles are mounted on the mounting mat.

2. A tile and mounting mat assembly as claimed in claim 1, wherein each pair of the feet is provided with two protrusions facing each other.

3. A tile and mounting mat assembly as claimed in claim 1, wherein each positioning post is in the shape of a tapered cylinder and a slot is formed on the distal end of each positioning post.

4. A tile and mounting mat assembly as claimed in claim 1, wherein the primary ribs are provided with a plurality of supporting posts on an underside thereof.

5. A tile and mounting mat assembly as claimed in claim 1, wherein the secondary ribs are provided with a supporting pad at each of the second intersection points.

6. A tile and mounting mat assembly as claimed in claim 1, wherein the primary ribs are provided with a draining hole at the first intersection point.

7. A tile and mounting mat assembly as claimed in claim 1, wherein the number of tiles is four.

8. A tile and mounting mat assembly as claimed in claim 2, wherein the number of holes in the tile is four.

9. A tile and mounting mat assembly as claimed in claim 3, wherein the number of primary ribs is two, so as to form one first intersection point and four frames, and the number of secondary ribs is four, so as to form four second intersection points and partition each of the frames into a 3 by 3 matrix of openings, whereby the four tiles are mounted on the mat.

10. A tile and mounting mat assembly as claimed in claim 9, wherein a middle opening of the matrix is filled with a reinforcing plate.

* * * * *